US006916390B2

(12) United States Patent
Augier et al.

(10) Patent No.: US 6,916,390 B2
(45) Date of Patent: Jul. 12, 2005

(54) SEMI-CONTINUOUS TWO-COMPONENT PROCESS FOR PRODUCING A COMPOSITE EXPLOSIVE CHARGE COMPRISING A POLYURETHANE MATRIX

(75) Inventors: Jean-Paul Augier, Macau (FR); Bernard Mahe, Le Thor (FR); Alain Bonnel, Sorgues (FR)

(73) Assignee: Eurenco France, Paris (FR)

( * ) Notice: Subject to any disclaimer, the term of this patent is extended or adjusted under 35 U.S.C. 154(b) by 358 days.

(21) Appl. No.: 10/341,412

(22) Filed: Jan. 14, 2003

(65) Prior Publication Data

US 2005/0115652 A1 Jun. 2, 2005

(30) Foreign Application Priority Data

Feb. 1, 2002 (FR) ..... 02 01213

(51) Int. Cl.[7] ..... D03D 23/00
(52) U.S. Cl. ..... 149/109.6; 149/19.4
(58) Field of Search ..... 149/19.4, 19.92, 149/109.6

(56) References Cited

U.S. PATENT DOCUMENTS

| | | | |
|---|---|---|---|
| 4,191,480 | A | 3/1980 | Hiorth |
| 4,632,715 | A | 12/1986 | Curtis |
| 5,085,717 | A | 2/1992 | Berard et al. |
| 5,114,630 | A | 5/1992 | Newman et al. |
| 5,529,212 | A | 6/1996 | Terhardt |
| 5,739,252 | A | 4/1998 | Kirchmeyer et al. |

FOREIGN PATENT DOCUMENTS

| | | |
|---|---|---|
| DE | 41 15 201 A1 | 1/1992 |
| WO | WO 92/22377 | 12/1992 |
| WO | WO 01/72861 A2 | 10/2001 |

OTHER PUBLICATIONS

J. Quinchon et al., "Powders, Propellants and Explosives," vol. 1, Explosives: Technique and Documentation, 1982, pp. 190–192.

J.M. Tauzia, "Some Comments on Processing Energetic Materials," Symposium: Compatibility and Processing Arranged by the American Defense Preparedness Association (ADPA), Oct. 23–25, 1989, Virginia Beach (USA).

*Primary Examiner*—Aileen Felton
(74) *Attorney, Agent, or Firm*—Oliff & Berridge, PLC

(57) ABSTRACT

In the military field of explosive munitions, a semi-continuous process produces a composite explosive charge composing a charged solid polyurethane matrix, the charge of which is pulverulent and comprise at least one nitro-organic explosive, by introduction into a mould of a pastry explosive composition and then thermal crosslinking of this composition. The composition is obtained by mixing constituents essentially comprising a polyol prepolymer, a plasticizer, a polyisocyanate monomer and a pulverulent solid charge comprising at least one nitro-organic explosive. This simple and economic process makes it possible to dispense, without disadvantage, with the pot life/curing time of the composition compromise.

20 Claims, No Drawings

SEMI-CONTINUOUS TWO-COMPONENT PROCESS FOR PRODUCING A COMPOSITE EXPLOSIVE CHARGE COMPRISING A POLYURETHANE MATRIX

The present invention relates to the military field, more particularly to that of explosive munitions, such as bombs and shells.

A more specific subject-matter of the invention is a novel process for producing composite explosive charges comprising a solid polyurethane matrix.

The term "composite explosive" is conventionally understood to mean a functionally detonatable pyrotechnical composition composed of a charged solid polymeric matrix, generally a polyurethane matrix, the said charge being pulverulent and comprising a nitro-organic explosive charge, for example hexogen, octogen, ONTA (oxynitrotriazole) or a mixture of at least two of these compounds.

Composite explosive charges and the way of obtaining them are described, for example, by J. Quinchon, les poudres, propergols et explosifs [Powders, propellants and explosives], Volume 1, les explosifs [Explosives], Technique et Documentation, 1982, pages 190–192. The pulverulent charge is mixed in a blender with a liquid polymerizable resin, for example a prepolymer comprising hydroxyl endings. A paste is obtained, which paste can be cast in a mould and then polymerized by curing. It is possible, by the choice and the adjustment of the agents for crosslinking the resin, the catalysts and other additives, to obtain moulded items with varied characteristics.

There are disadvantages and limitations to this conventional process for blending all the constituents, which are introduced and mixed in a blender according to a defined sequence.

When mixing is complete, the paste has to be used within a fairly short period of time (pot life). Extending the pot life by reducing the level of crosslinking catalyst has as counterpart an increased polymerization time, the temperature being limited, inter alia, by the pyrotechnic nature of some constituents.

To operate in this way thus requires a technical compromise between the pot life and the curing time, as well as a necessary linking of the sequences for blending and casting the paste.

It also requires a compromise in terms of economics between the size of the blender and the size of the moulded object.

This is because, while this batch process appears to be fairly well suited to the manufacture of large objects, such as underwater mines, torpedoes and bombs, on the other hand it proves to be highly disadvantageous and expensive in the manufacture of large amounts of small moulded objects at a high rate, for example in the manufacture, from a blend of 1 to 3 t of paste, of several hundred shells with a diameter of the order of 50 to 100 mm each comprising several hundred grams to several kilos of composite explosive.

In this situation, it is necessary to have a high pot life in order to be able to charge numerous munitions with the same blend, which has as counterpart a particularly long time for crosslinking the paste and a very high cost of the manufacturing cycle because of the time during which equipment and personnel are occupied.

If the size of the blender is reduced, the number of munitions to be filled per blend is reduced, which is economically disadvantageous.

A person skilled in the art has tried to escape from this pot life/curing time straightjacket and from this necessary and precise linking of the blending and casting operations.

To solve this problem, J. M. Tauzia suggested, in a communication entitled "Some Comments on Processing Energetic Materials" at the symposium "Compatibility and Processing" arranged by the American Defense Preparedness Association (ADPA) on 23–25 Oct. 1989 at Virginia Beach (United States), a two-component process in which 2 chemically stable polymeric components exhibiting approximately the same level of charge and the same viscosity are first of all prepared from the constituents batchwise in blenders.

These 2 pasty components are subsequently mixed continuously with a ratio by mass of approximately 1.

This two-component process, while it indeed makes it possible to eliminate the pot life/curing time compromise and renders possible the storage of the 2 components for several weeks, has several disadvantages.

A first disadvantage is that it proves to be highly problematic to continuously mix the 2 pasty components to obtain a homogeneous product.

A second disadvantage is that the 2 components are pyrotechnically active (presence of explosive charges) and that it [sic] therefore both have to be prepared and then stored in secure plants.

A third disadvantage is that the solid polymeric matrix of the composite explosive finally obtained is different from that which is obtained, with the same constituents in the same proportions, according to the conventional batch process. This is because, according to Tauzia, the isocyanate component is polymeric. The fact of preparing, as an intermediate, an isocyanate prepolymer from the starting isocyanate monomer has the consequence of producing a solid polyurethane matrix which is different from that obtained according to the batch process by directly mixing all the isocyanate monomer and all the hydroxyl prepolymer.

This difference in structure of the solid polyurethane matrix results in undesirable differences in mechanical and/or detonating properties, requiring very expensive and disadvantageous requalification of the final product.

The two-component process described by J. M. Tauzia is therefore not entirely satisfactory.

A main subject-matter of the present invention is an improvement to this two-component process and the present invention provides a semi-continuous two-component process for producing a composite explosive charge comprising a polyurethane matrix which exhibits neither the disadvantages of the conventional batch process nor the abovementioned disadvantages of the semi-continuous two-component process described by J. M. Tauzia.

It has been discovered, unexpectedly, that it is possible to obtain a composite explosive charge comprising a polyurethane matrix according to a simple and inexpensive semi-continuous two-component process which does not require requalification of the final product by virtue of a very precise combination of technical characteristics relating to the distribution of the constituents in the 2 components and to the ratio by mass of mixture of the 2 components.

More specifically, a subject-matter of the present invention is a semi-continuous process for producing a composite explosive charge composed of a charged solid polyurethane matrix, the charge of which is solid and pulverulent and comprises at least one nitro-organic explosive, by introduction into a mould of a pasty explosive composition and then thermalcrosslinking of this composition, the said composition being obtained by mixing constituents essentially comprising a polyol prepolymer, a plasticizer, a polyisocyanate monomer and a pulverulent solid charge comprising at least one nitro-organic explosive.

This process according to the invention is characterized in that, to obtain the pasty explosive composition:

2 components:

a pasty component A comprising all the polyol prepolymer and all the pulverulent charge, a liquid component B comprising all the polyisocyanate monomer, the plasticizer being distributed without distinction between the 2 components A and B, are first of all prepared under batchwise conditions from the combined constituents by simple homogeneous mixing, the component A and the component B are subsequently mixed under continuous conditions such that the component A/component B ratio by mass is constant and between 95/5 and 99.5/0.5.

The fact should be clearly noted, according to the invention, in addition to the very specific component A/component B ratio by mass, that the components A and B do not have the same viscosity, that one is pasty and comprises all the charge and polyol prepolymer, and that the other is liquid and comprises all the polyisocyanate monomer as is, without chemical modification, in particular without prepolymerization using a polyol.

This combination of distinctive technical characteristics in comparison with the semi-continuous two-component process of the state of the art has the technical effect of eliminating all the abovementioned disadvantages and of rendering the process particularly simple and inexpensive.

Only the component A is pyrotechnically active, which considerably restricts the safety constraints, and the mixing of the components A and B is easily homogenized.

Furthermore, the physicochemical, mechanical, detonating and vulnerability properties of the final product are identical to those of the product obtained according to the conventional batch process from the same constituents in the same proportions, which avoids a disadvantageous requalification of the product.

The operations of preparing the components A and B are completely independent of the operations of mixing components A and B and of casting and can be carried out in parallel. These components A and B can be stored if need be for several weeks before being mixed.

Furthermore, the process according to the invention is completely independent of the pot life owing to the fact that small amounts of components A and B are rapidly and continuously mixed, which makes it possible to increase the percentage of crosslinking catalyst and to consequently decrease the time for crosslinking the pasty explosive composition in the mould and/or to carry out this crosslinking at a lower temperature.

Crosslinking at ambient temperature (20° C.) is even possible, which is particularly advantageous.

According to the present invention, the pasty explosive composition is obtained from the usual constituents used according to the prior processes and which are well known to a person skilled in the art.

These constituents comprise essentially a polyol prepolymer, a plasticizer, a polyisocyanate monomer and a pulverulent charge comprising at least one nitro-organic explosive.

The term "essentially" should be understood as meaning that the abovementioned constituent [sic] are always present and represent overall more than 90% by weight with respect to the total weight of the pasty explosive composition.

Preferably, the sum of the contents by weight of polyol prepolymer, plasticizer, polyisocyanate monomer and pulverulent charge represents between 98% and 100% of the combined constituents.

Generally, the physical states, solid, liquid or pasty, of the constituents and of the compositions should be understood, in the present description, as being the physical states at ambient temperature (approximately 20° C.) and at atmospheric pressure (approximately 0.1 MPa).

The term "nitro-organic explosive" should be understood conventionally as meaning an explosive chosen from the group consisting of nitroaromatic explosives (comprising at least one C—$NO_2$ group, the carbon atom forming part of an aromatic ring), nitric ester explosives (comprising at least one C—O—$NO_2$ group) and nitramine explosives (comprising at least one C—N—$NO_2$ group).

Preferably, the nitro-organic explosive is chosen from the group consisting of hexogen, octogen, pentrite, 5-oxo-3-nitro-1,2,4-triazole (ONTA), triaminotrinitrobenzene, nitroguanidine and their mixtures, that is to say all the mixtures of at least two of the abovementioned compounds.

In a particular [sic] preferred way, the nitro-organic explosive is chosen from the group consisting of hexogen, octogen, ONTA and their mixtures.

According to a preferred alternative form, the content of nitro-organic explosive is between 15% and 90% by weight with respect to the composite explosive and the content of pulverulent solid charge is between 75% and 90% by weight with respect to the composite explosive.

According to an alternative form, the pulverulent solid charge is composed only of nitro-organic explosive.

According to another alternative form, the pulverulent solid charge also comprises at least one compound other than the nitro-organic explosive.

It can, for example, comprise a reducing metal preferably chosen from the group consisting of aluminium, zirconium, magnesium, tungsten, boron and their mixtures. In a particularly preferred way, the reducing metal is aluminium.

The content of reducing metal can, for example, be between 0% and 35% by weight with respect to the composite explosive.

The pulverulent charge can also comprise, in combination or not in combination with a reducing metal, an inorganic oxidizing agent preferably chosen from the group consisting of ammonium perchlorate, which is particularly preferred, potassium perchlorate, ammonium nitrate, sodium nitrate and their mixtures.

The content of inorganic oxidizing agent can, for example, be between 0% and 45% by weight with respect to the composite explosive.

When the pulverulent solid charge comprises at least one compound other than the nitro-organic explosive, this other compound is preferably chosen from the group consisting of ammonium perchlorate, aluminium and their mixtures.

According to the present invention, the polyol prepolymer is a more or less viscous liquid. Its number-average molecular mass (Mn) is preferably between 500 and 10 000 and is [sic] preferably chosen from the group consisting of polyisobutylene polyols, polybutadiene polyols, polyether polyols, polyester polyols and polysiloxane polyols. In a particularly preferred way, a polybutadiene comprising hydroxyl endings is used.

The polyisocyanate monomer is a liquid preferably chosen from the group consisting-of toluene diisocyanate (TDI), isophorone diisocyanate (IPDI), dicyclohexylmethylene [sic] diisocyanate (MDCI), hexamethylene diisocyanate (HMDI), biuret trihexane isocyanate (BTHI), 3,5,5-trimethyl-1,6-hexamethylene diisocyanate, and their mixtures.

In a particularly preferred way, IPDI or MDCI is used.

The plasticizer is also a liquid, preferably a monoester, such as isodecyl pelargonate (IDP), or a polyester chosen from the group consisting of phthalates, adipates, azelates and acetates. Among polyesters, triacetin, alkyl phthalates, such as dioctyl phthalate (DOP), alkyl azelates, such as dioctyl azelate (DOZ), and alkyl adipates, such as dioctyl adipate (DOA), are particularly preferred.

In addition to the abovementioned essential constituents, the combined constituents can also comprise at least one additive chosen from the group consisting of crosslinking catalysts (catalysts of the NCO/OH reaction), wetting agents, antioxidants and agents for binder-charge adhesion.

Use is preferably made, as crosslinking catalyst, of dibutyltin dilaurate (DBTL), but use may also be made of any other catalyst well known to a person skilled in the art, in particular other organotin compounds, such as a stannous salt of a carboxylic acid, a trialkyltin oxide, a dialkyltin dihalide or a dialkyltin oxide. Mention may be made, for example, of dibutyltin diacetate, diethyltin diacetate, dioctyltin dioxide and stannous octoate.

Use may also be made, as catalyst, of a tertiary amine, in particular a trialkylamine, or else an organobismuth compound, such as triphenylbismuth.

Use is preferably made, as wetting agent, of a lecithin, such as soybean lecithin, or a siloxane.

Use is preferably made, as antioxidant, of di-tert-butyl-para-cresol (Ionol) or 2,2'-methylenebis(4-methyl-6-(tert-butyl)phenol) (MBP5).

Use is preferably made, as agent for binder-charge adhesion, of triethylenepentamineacrylonitrile (TEPAN) or certain compounds derived from silanols, such as (3-(triethoxysilyl)propyl)succinic anhydride ($C_{13}H_{24}O_6Si$).

The constituents can also comprise a compound for extending the polyurethane polymeric chain.

This compound is generally a polyol monomer of low mass, of less than approximately 300, preferably a triol, such as trimethylolpropane (TMP), or a diol, such as dipropylene glycol.

According to the present invention, 2 components:

a pasty component A comprising all the polyol prepolymer and all the pulverulent solid charge, a liquid component B comprising all the polyisocyanate monomer, the plasticizer being distributed without distinction between the 2 components A and B, are first of all prepared under batchwise conditions from the combined constituents by simple homogeneous mixing.

Preferably, the component A comprises all the plasticizer.

In a particularly preferred way, the component B is composed solely of the polyisocyanate monomer.

When the constituents comprise a chain-extending compound, it is essential for the latter to be entirely included in the component A.

When the constituents comprise at least one additive chosen from the group consisting of crosslinking catalysts, wetting agents, antioxidants and agents for binder-charge adhesion, this additive can be distributed without distinction between the 2 components A and B but it is preferably entirely included in the component A.

According to a preferred alternative form, the constituents other than the polyol prepolymer, the plasticizer, the polyisocyanate monomer and the pulverulent solid charge are chosen exclusively from the group consisting of chain-extending compounds, crosslinking catalysts, wetting agents, antioxidants and agents for binder-charge adhesion, the chain-extending compounds being entirely included in the component A, it being possible for the crosslinking catalysts, the wetting agents, the antioxidants and the agents for binder-charge adhesion themselves to be distributed without distinction between the 2 components A and B. However, they are preferably included in the component A.

The components A and B are prepared independently under batchwise conditions by simple homogeneous mixing, for example in a blender, and are chemically stable, that is to say that there is no chemical reaction between the mixed constituents of each component and that all the constituents retain their structural identity, both during mixing and during subsequent storage and independent of the components A and B.

According to the present invention, to obtain a pasty explosive composition, the component A and the component B are subsequently mixed under continuous conditions such that the component A/component B ratio by mass is constant and between 95/5 and 99.5/0.5, preferably between 98/2 and 99.2/0.8, for example in the region of 99.

This continuous mixing between the component A and the component B is, for example and preferably, carried out in a static mixer, a mixer well known to a person skilled in the art, in the form of a pipe comprising crosspieces which force the product passing therethrough to separate and then to remix.

According to a preferred alternative form, the components A and B are each present in a vessel equipped with a piston, the moving of which by means of a motor makes it possible to feed, with components A and B, a mixer head situated upstream of the static mixer, so that the contents of the mixer head flow into the static mixer.

The pressure on the mixture of the components A and B in the mixer head is preferably between 1 MPa and 10 MPa and the 2 pistons are preferably driven by the same motor.

In view of the high component A/component B ratio by mass, it is advantageous to emphasize that such an assembly offers the possibility of linking together several vessels of the component A for the same vessel of component B, without disrupting the continuous process.

The static mixer according to the invention is preferably composed of several elements mounted in series, in the form of a pipe, having a diameter preferably of between 15 mm and 60 mm.

Use is made, for example, of between 6 and 15 mixing elements, such as those sold commercially and well known to a person skilled in the art.

According to another preferred alternative form, the pasty explosive composition is obtained with a throughput by volume of between 0.1 l/min and 5 l/min, better still of between 0.3 l/min and 1 l/min, for example in the region of 0.5 l/min.

The abovementioned preferred alternative form, according to which the components A and B are each present in a vessel equipped with a piston, makes possible very precise meterings and a very uniform feed, but it is also possible, for example, to feed the static mixer using metering pumps connected to the tanks for storage of the components A and B.

The static mixer is generally equipped with a jacket in order to make possible adjustment of the temperature.

Each element can be adjusted to a different temperature. The final element can, for example, be adjusted to the temperature chosen for the subsequent crosslinking of the explosive paste in the moulds, the other elements situated upstream being adjusted to a lower temperature.

The vessels or the tanks comprising the components A and B can also be equipped with a heating system.

According to a preferred alternative form, the component A and the component B are mixed at a temperature of between 40° C. and 80° C.

According to the present invention, the pasty explosive composition obtained after mixing the components A and B is introduced into a mould in which it is subsequently subjected to thermal crosslinking, for example in an oven.

This crosslinking results from the formation of urethane bridges as a result of the reaction of the hydroxyl functional groups of the polyol prepolymer and optionally of the chain-extending compound with the isocyanate functional groups of the polyisocyanate monomer. The crosslinking rate increases with the temperature and the content of catalyst.

According to a preferred alternative form, the mould is composed of the casing, generally metal casing, of a munition, for example of a shell.

Preferably, and in particular when a static mixer is used to mix the components A and B under continuous conditions, the pasty explosive composition emerging from the mixer is introduced under computer control into a large series of moulds, for example several hundred shell casings.

According to a preferred alternative form of the invention, the temperature for crosslinking the pasty explosive composition introduced into the moulds is between 15° C. and 80° C.

The crosslinking can in particular be carried out at ambient temperature (approximately 20° C.), which is particularly advantageous.

According to another preferred alternative form, the crosslinking temperature is identical or similar to that at which the component A and the component B are mixed.

The following nonlimiting example illustrates the invention.

EXAMPLE 1

Preparation of a Composite Explosive Charge Comprising a Polyurethane Matrix Charged with Hexogen Pasty component A A homogeneous pasty component A is prepared, in a vertical stainless steel blender with a capacity of 35 litres, by mixing the following constituents, in the relative proportions mentioned, at 60° C. for 4 h:

- 7.49 parts by weight of the polybutadiene comprising hydroxyl endings with a number-average molecular mass of approximately 2 500 and with a functionality of hydroxyl functional groups of approximately 2.2 sold by Atochem under the name R45HT (polyol prepolymer)
- 0.08 part by weight of trimethylolpropane (chain-extending compound)
- 3.37 parts by weight of dioctyl adipate (plasticizer)
- 0.12 part by weight of MBP5 (antioxidant)
- 0.12 part by weight of soybean lecithin (wetting agent)
- 0.06 part by weight of TEPAN (agent for binder-charge adhesion)
- 0.0001 part by weight of dibutyltin dilaurate (crosslinking catalyst)
- 88.76 parts by weight of pulverulent hexogen (charge made of nitro-organic explosive).

Liquid component B

The component B is composed solely of isophorone diisocyanate (IPDI), that is to say of the polyisocyanate monomer.

Preparation of a Pasty Explosive Composition by Mixing the Components A and B Under Continuous Conditions The continuous mixing between the component A and the component B is carried out in a static mixer composed of 13 elements mounted in series with a length of 32 mm and a diameter of 32 mm, after transfer of each of the components A and B into a vessel equipped with a piston. The vessel comprising the component A has a diameter of 300 mm and a height of 250 mm. The vessel comprising the component B has a diameter of 40 mm and a height of 250 mm.

Moving the 2 pistons by means of the same motor makes it possible to feed components A and B to a mixer head situated upstream of the static mixer, so that, on the one hand, the component A/component B ratio by mass is constant and equal [lacuna] 99.14/0.86 and, on the other hand, that the contents of the mixer head flow into the static mixer.

The pressure on the mixture of the components A and B in the mixer head is 2.5 MPa.

The entire plant, that is to say in particular the 2 vessels comprising components A and B, the mixer head and the 13 elements of the static mixer, is thermostatically controlled at 60° C.

At the outlet of the static mixer, the pasty explosive composition is obtained with a throughput of 0.35 l/min.

This pasty explosive composition is homogeneous and has the following composition by weight:

polyol prepolymer: 7.42%
chain extender: 0.07%
polyisocyanate monomer: 0.86%
plasticizer: 3.35%
antioxidant: 0.12%
wetting agent: 0.12%
agent for binder-charge adhesion: 0.06%
crosslinking catalyst: 0.0001%
hexogen: 88.00%

Preparation of the Composite Explosive Charge by Casting in a Mould and then Crosslinking the Explosive Composition The pasty explosive composition exiting from the static mixer is cast at ambient temperature, approximately 20° C., in metal moulds, with an 80 mm×80 mm square cross section and a height of 120 mm, positioned beforehand in a casting chamber connected to a valve situated at the outlet of the static mixer, the chamber-valve leaktightness being provided by a rubber ring.

The dynamic viscosity of the pasty explosive composition at the outlet of the static mixer is 5 800 poises.

This operation of charging the moulds is carried out under a partial vacuum of approximately 15 mmHg in the casting chamber.

After charging, the moulds are introduced into an oven at 60° C. for 7 days, which makes it possible to crosslink the binder of the explosive composition and to finally obtain a composite explosive charge composed of 12% by weight of polyurethane matrix and of 88% by weight of hexogen, the density of which is 1.62 g/cm$^3$.

During the crosslinking at 60° C. of the composition in the moulds, the change in the dynamic viscosity of this composition as a function of the time was monitored:

after 2 h: 6 900 poises
after 4 h: 7 900 poises
after 6 h: 9 100 poises.

The tensile mechanical properties of the composite explosive obtained were determined using a conventional tensile testing machine at 20° C. with a pull rate of 50 mm/min, starting from standardized monodimensional test specimens, according to a method well known to a person skilled in the art (mean of 6 measurements):

Maximum stress (MS): 0.8 MPa
Modulus of elasticity (E): 15 MPa
Elongation at maximum stress ($e_m$): 9%
Breaking stress (BS): 0.8 MPa
Elongation at break ($e_b$): 10%

These mechanical properties are satisfactory for this type of charge.

Furthermore, the sensitivity to friction and the sensitivity to impact of the composite explosive obtained were determined according to the Julius Peters methods and devices well known to a person skilled in the art.

The sensitivity to impact is 25 joules.

For the sensitivity to friction, 20 positive tests out of 30 are found at 353 N, the maximum limit of the device.

COMPARATIVE EXAMPLE

This comparative example does not form part of the invention. It was carried out for the sole purpose of showing that the physicochemical and mechanical properties of the composite explosive obtained according to the semi-continuous two-component process which is a subject-matter of the invention are identical to those of the composite explosive obtained from the same constituents, in the same proportions, according to the conventional batch process used to date by a person skilled in the art.

According to this comparative example, the following are introduced into a vertical blender with a capacity of 135 litres:

7.42 parts by weight of the polyol prepolymer used for Example 1

0.07 part by weight of trimethylolpropane 3.35 parts by weight of dioctyl adipate 0.12 part by weight of MBP5

0.12 part by weight of soybean lecithin 0.06 part by weight of TEPAN 0.0001 part by weight of dibutyltin dilaurate 88.00 parts by weight of pulverulent hexogen.

All these constituents are identical to those used for Example 1 (same source and same characteristics).

After mixing for 4 h at 60° C., a partial vacuum of approximately 15 mmHg is produced in the blender and then stirring is again continued for 4 h at 60° C.

The dynamic viscosity of the paste is then 4 800 poises.

0.86 part by weight of IPDI (same source and same characteristics as that used for Example 1) is then added and then the mixture is stirred for 30 min at 60° C. under a partial vacuum of approximately 15 mmHg.

The pasty explosive composition obtained has the same composition by weight as that obtained for Example 1.

This composition is subsequently cast in moulds identical to those used for Example 1 and is then crosslinked for 7 d at 60° C. in an oven.

During the crosslinking at 60° C. of the composition, the change in the viscosity as a function of the time was monitored, the starting point of the time being the moment at which the IPDI is introduced into the blender:
after 2 h: 7 300 poises
after 4 h: 9 900 poises
after 6 h: 12 500 poises It is found that the change in the viscosity of the pasty composition is not significantly different from that measured for Example 1.

The composite explosive obtained after crosslinking for 7 d at 60° C. has a density of 1.62 g/cm$^3$, i.e. the same value as that of the composite explosive obtained in Example 1.

The mechanical properties of the composite explosive obtained according to this comparative example were determined under the same conditions as those described for Example 1:
Maximum stress (MS): 1.0 MPa
Modulus of elasticity (E): 18 MPa
Elongation at maximum stress (em) 10%
Breaking stress (BS) 1.0 MPa
Elongation at break ($e_b$): 11%

None of these values is significantly different from those obtained for the composite explosive of Example 1.

The sensitivity to friction and the sensitivity to impact of the composite explosive obtained were also determined according to the same methods as those used for Example 1.

The sensitivity to impact is 21 joules.

For the sensitivity to friction, 16 positive tests out of 30 are found at 353 N, the maximum limit of the device.

These values are not significantly different from those obtained for the composite explosive of Example 1.

What is claimed is:

1. Semi-continuous process for producing a composite explosive charge composed of a charged solid polyurethane matrix, the charge of which is pulverulent and comprises at least one nitro-organic explosive, by introduction into a mould of a pasty explosive composition and then thermal crosslinking of this composition, the said pasty explosive composition being obtained by mixing constituents essentially comprising a polyol prepolymer, a plasticizer, a polyisocyanate monomer and a pulverulent solid charge comprising at least one nitro-organic explosive, characterized in that, to obtain the pasty explosive composition:

2 components:

a pasty component A comprising all the polyol prepolymer and all the pulverulent solid charge, a liquid component B comprising all the polyisocyanate monomer, the plasticizer being distributed without distinction between the 2 components A and B, are first of all prepared under batchwise conditions from the combined constituents by simple homogeneous mixing, the component A and the component B are subsequently mixed under continuous conditions such that the component A/component B ratio by mass is constant and between 95/5 and 99.5/0.5.

2. Process according to claim 1, characterized in that the sum of the contents by weight of polyol prepolymer, plasticizer, polyisocyanate monomer and pulverulent solid charge represents between, 98% and 100% of the combined constituents.

3. Process according to claim 1, characterized in that the constituents also comprise a chain-extending compound and in that this compound is entirely included in the component A.

4. Process of [sic] claim 1, characterized in that the constituents also comprise at least one additive chosen from the group consisting of crosslinking catalysts, wetting agents, antioxidants and agents for binder-charge adhesion, this additive being distributed without distinction between the 2 components A and B.

5. Process according to claim 4, characterized in that the additive is entirely included in the component A.

6. Process according to claim 1, characterized in that the other constituents are chosen exclusively from the group consisting of chain-extending compounds, crosslinking catalysts, wetting agents, antioxidants and agents for binder-charge adhesion, the chain-extending compounds being entirely included in the component A, the crosslinking catalysts, the wetting agents, the antioxidants and the agents for binder-charge adhesion being themselves distributed without distinction between the 2 components A and B.

7. Process according to claim 1, characterized in that the component B is composed solely of the polyisocyanate monomer.

8. Process according to claim 1, characterized in that the component A/component B ratio by mass is between 98/2 and 99.2/0.8.

9. Process according to claim 1, characterized in that the pasty explosive composition is obtained with a throughput by volume of between 0.1 and 5 l/min.

10. Process according to claim 1, characterized in that the mixing between the component A and the component B is carried out in a static mixer.

11. Process according to claim 10, characterized in that the components A and B are each present in a vessel equipped with a piston, the moving of which by means of a motor makes it possible to feed, with components A and B, a mixer head situated upstream of the static mixer.

12. Process according to claim 11, characterized in that the pressure on the mixture of the components A and B in the mixer head is between 1 MPa and 10 MPa.

13. Process according to claim 11, characterized in that the 2 pistons are driven by the same motor.

14. Process according to claim 1, characterized in that the static mixer is composed of several mixing elements mounted in series.

15. Process according to claim 1, characterized in that the temperature for crosslinking the pasty explosive composition is between 15° C. and 80° C.

16. Process according to claim 1, characterized in that the component A and the component B are mixed at a temperature of between 40° C. and 80° C.

17. Process according to claim 16, characterized in that the temperature for crosslinking the pasty explosive composition is identical or similar to that at which the component A and the component B are mixed.

18. Process according to claim 16, characterized in that the temperature for crosslinking the pasty explosive composition is ambient temperature.

19. Process according to claim 1, characterized in that the polyol prepolymer has a number-average molecular mass (Mn) of between 500 and 10 000 and is chosen from the group consisting of polyisobutylene polyols, polybutadiene polyols, polyether polyols, polyester polyols and polysiloxane polyols.

20. Process according to claim 1, characterized in that the polyisocyanate monomer is chosen from the group consisting of toluene diisocyanate, isophorone diisocyanate, dicyclohexylmethylene [sic] diisocyanate, hexamethylene diisocyanate, biuret trihexane isocyanate, 3,5,5-trimethyl-1, 6-hexamethylene diiso-cyanate, and their mixtures.

* * * * *